US005324547A

United States Patent [19]

Ohhashi et al.

[11] Patent Number: 5,324,547

[45] Date of Patent: Jun. 28, 1994

[54] METHOD OF APPLYING METALLIC PAINT

[75] Inventors: Yutaka Ohhashi; Shin Kawaguchi; Kenji Fukuta, all of Aichi, Japan

[73] Assignee: Toyota Jidosha Kabushiki Kaisha, Toyota, Japan

[21] Appl. No.: 53,341

[22] Filed: Apr. 28, 1993

Related U.S. Application Data

[63] Continuation of Ser. No. 740,152, Aug. 5, 1991, abandoned.

[30] Foreign Application Priority Data

Aug. 15, 1990 [JP] Japan ..... 2-215291

[51] Int. Cl.[5] ..... B05D 1/02; B05D 7/14

[52] U.S. Cl. ..... 427/479; 427/480; 427/424

[58] Field of Search ..... 427/33, 424, 479, 480; 118/682, 697, 705, 699, 323

[56] References Cited

U.S. PATENT DOCUMENTS 4,578,965 4/1986 Brossman ..... 118/323 X
5,103,761 4/1992 Ishibashi et al. ..... 118/323

FOREIGN PATENT DOCUMENTS 57-165064 10/1982 Japan .
58-100013 6/1983 Japan .
58-122069 7/1983 Japan .
60-255170 12/1985 Japan .
61-234970 10/1986 Japan .
62-13557 1/1987 Japan .
1-315361 12/1989 Japan .
1315361 12/1989 Japan .
1209651 10/1970 United Kingdom .

*Primary Examiner*—Shrive Beck
*Assistant Examiner*—Bret Chen
*Attorney, Agent, or Firm*—Finnegan, Henderson, Farabow, Garrett and Dunner

[57] ABSTRACT

A method of applying a metallic paint to an object conveyed by means of a conveyor, by reciprocating one or more rotary atomizing electrostatic painting machines at right angles to the direction in which the object is conveyed. The speed of the reciprocation of the painting machines is controlled according to the speed of the conveyor so that the pitch between the adjacent orbits of the strokes of the reciprocation of the machines drawn on the object may become a predetermined value.

5 Claims, 2 Drawing Sheets

METHOD OF APPLYING METALLIC PAINT

This application is a continuation, of U.S. application Ser. No. 740,152, filed Aug. 5, 1991, now abandoned.

BACKGROUND OF THE INVENTION

1. Field of the Invention

The present invention relates to a method of applying a metallic paint using a rotary atomizing electrostatic painting machine and, more particularly, to a method of applying a metallic paint by reciprocating a painting machine at right angles to the direction in which an object to be painted is conveyed at a constant speed.

2. Description of the Prior Art

Since rotary atomizing electrostatic paint spraying can apply paint at a higher transfer efficiency than air atomizing electrostatic spraying and airless atomizing electrostatic spraying, it has often been used to paint automotive bodies and the like in recent years.

FIG. 4 shows the conventional rotary atomizing electrostatic spray equipment. The body of this equipment is indicated by numeral 1. A rotor 3 is supported by an air bearing 2 inside the body 1 and extends out through the body 1. An atomizing head 4 is firmly fixed to the front end of the rotor 3 which is located outside the body 1. A head member 5 is mounted to the front end of the body 1 and provided with a multiplicity of blowoff holes 6 for ejecting shaping air toward the outer fringe of the atomizing head 4. A paint supply tube 7 extends along the axis of the body in such a way that it is not in contact with the rotor 3.

In the operation of the conventional rotary atomizing electrostatic spray equipment constructed as described above, the atomizing head 4 is spun at a high speed by a drive means (not shown) and, at the same time, a high voltage is applied to the head 4. Under this condition, a paint is supplied through the paint supply tube 7. Then, the paint flows out to the front surface of the head 4 from a hole 4*a* formed in the head 4, runs across the front surface, and shifts to the outer periphery. Then, the paint is atomized by centrifugal force. Concurrently, the atomized paint is electrically charged and travels toward the object to be painted. At this time, the paint is applied in the desired pattern by the shaping air ejected from the blowoff holes 6.

It is known that where a metallic paint including fragments of aluminum or mica is applied using the above-described rotary atomizing electrostatic spray equipment, the appearance of the finished object is much darker than the case in which it is painted by the use of an air atomizing spray machine. This phenomenon is understood in the manner described now. Since the particles of the paint are applied to the target surface mainly by electrostatic force, the speed of the paint particles colliding against the sprayed surface is lesser than in the air atomizing electrostatic spraying. Therefore, the fragments of aluminum or mica do not easily orient themselves parallel to the sprayed surface. Japanese Patent Laid-Open No. 315361/1989 discloses a painting method which solves the above problem. In particular, the pressure created by shaping air is increased to increase the speeds at which the paint particles collide against the object to be painted, for enhancing the lightness of the surface sprayed with the metallic paint. This technique yields considerably satisfactory results.

Another painting method has been used in which a painting machine is reciprocated perpendicularly to the direction of conveyance of a painted object conveyed at a constant speed. This method is disclosed, for example, in Japanese Patent Laid-Open Nos. 165064/1982 and 255170/1985. In this reciprocating painting method, the reciprocating painting machine draws a sinusoidal orbit on the sprayed surface of the painted object, as shown in FIG. 5. This method permits an object having a wide painted area such as an automotive body to be painted efficiently.

Accordingly, where an object having a wide coated area is painted with a metallic paint through the use of a rotary atomizing electrostatic spraying machine, this machine, of course, must be reciprocated.

However, in the painting method disclosed in the above cited Japanese Patent Laid-Open No. 315361/1989, the pressure created by the shaping air is increased. As a result, a negative pressure is produced ahead of the atomizing head. The particles of the paint are attracted into the region where this negative pressure is developed. This reduces the width of the pattern in which the paint is applied. This reduction in the width of the depositional pattern means an improvement of the transfer efficiency of the paint. If the aforementioned painting method is directly applied to the reciprocating painting to spray a metallic paint, and if the speed of the conveyor varies at all, then the boundary between the adjacent orbits drawn by the spraying machine becomes conspicuous. That is, so-called nonuniform paint spraying tends to occur. It substantially follows that the utilization of this method is urged to be abandoned. Japanese Utility Model Laid-Open No. 13557/1987 discloses another rotary atomizing electrostatic spraying machine in which shaping air is tilted outward about the axis of the atomizing head to widen the spraying pattern. This machine also inevitably produces a negative pressure ahead of the atomizing head. Therefore, this machine is unsuccessful in essentially solving the above-described problem.

SUMMARY OF THE INVENTION

In view of the foregoing problem with the prior art techniques, it is an object of the present invention to provide a method of painting an object with a metallic paint by the use of a rotary atomizing electrostatic painting machine in such a way that the produced paint film is certainly prevented from becoming nonuniform even if the machine is reciprocated and if the pressure of the shaping air is increased.

The above object is achieved by a method of applying a metallic paint, said method comprising the steps of: reciprocating at least one rotary atomizing electrostatic painting machine at right angles to the direction in which an object to be painted is conveyed by a conveyor; detecting the speed of the conveyor by a sensor; and controlling the speed of the reciprocation of the painting machine according to the speed detected by the sensor in such a way that the pitch S between the adjacent orbits of the strokes of the reciprocation of the machine becomes a predetermined value.

In one feature of the present invention, the number of said at least one rotary atomizing electrostatic painting machine which reciprocates as described above is arbitrary. Either one or plural painting machines can be used. In the latter case, the machines are arranged either in the direction of the conveyance of the object to be painted or perpendicularly to this direction of conveyance. Where the machines are arranged in the direction of the conveyance of the object, the pitch between the adjacent orbits of the strokes of the reciprocating motion is controlled to the predetermined value.

In another feature of the invention, no limitations are imposed to the posture of the at least one rotary atomizing electrostatic painting machine. For instance, the machine can be reciprocated horizontally while it faces downward. Also, the machine can be reciprocated vertically while it is kept horizontal. Where the machine is reciprocated horizontally, it can paint horizontal surfaces such as the hood and the roof of an automotive body. Where the machine is reciprocated vertically, it can paint side surfaces such as the surfaces of side members and door surfaces of an automotive body.

In a further feature of the invention, any arbitrary means can be adopted to reciprocate the rotary atomizing electrostatic painting machine. One example of this means is a reciprocator comprising a disk-shaped rotary cam and an electric motor which rotates the cam. The rotary movement of the motor is transformed into a rectilinear motion and transmitted to the painting machine. Another example is a reciprocator comprising an electric motor and a chain that is driven by the motor. The painting machine is carried on the chain. This motor is rotated forward and rearward to cause the machine to make rectilinear motion. In either case, the rotational speed of the motor is changed into a different speed to control the speed of the reciprocating motion of the painting machine.

In the novel method of applying a metallic paint in the manner as described above, the speed of the reciprocating motion of the rotary atomizing electrostatic painting machine is controlled according to the speed of the conveyor such that the pitch between the neighboring orbits of the strokes of the reciprocating motion of the machine becomes the predetermined value. Therefore, if the pressure of the shaping air is increased to thereby reduce the width of the depositional pattern, the resulting paint film can be prevented from becoming nonuniform.

Other objects and features of the invention will appear in the course of the description thereof which follows.

DETAILED DESCRIPTION OF THE INVENTION

Figure 1:
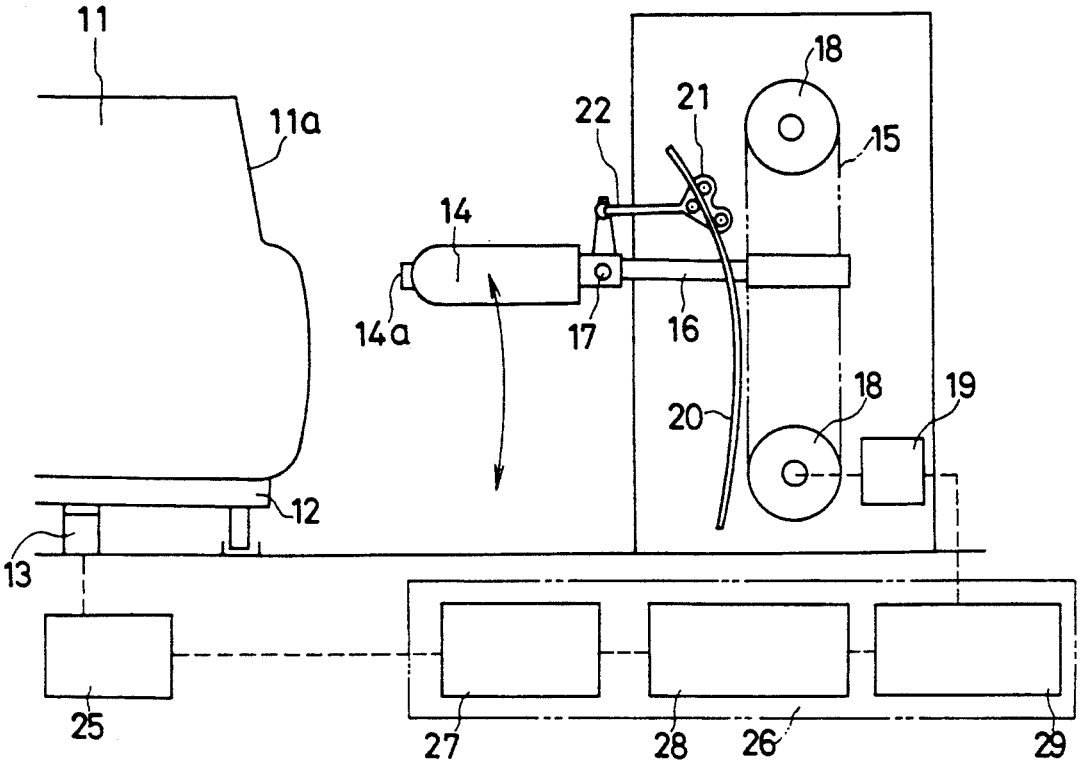
FIG. 1 is a block diagram of a painting system carrying out a painting method according to the invention.
Figure 4:
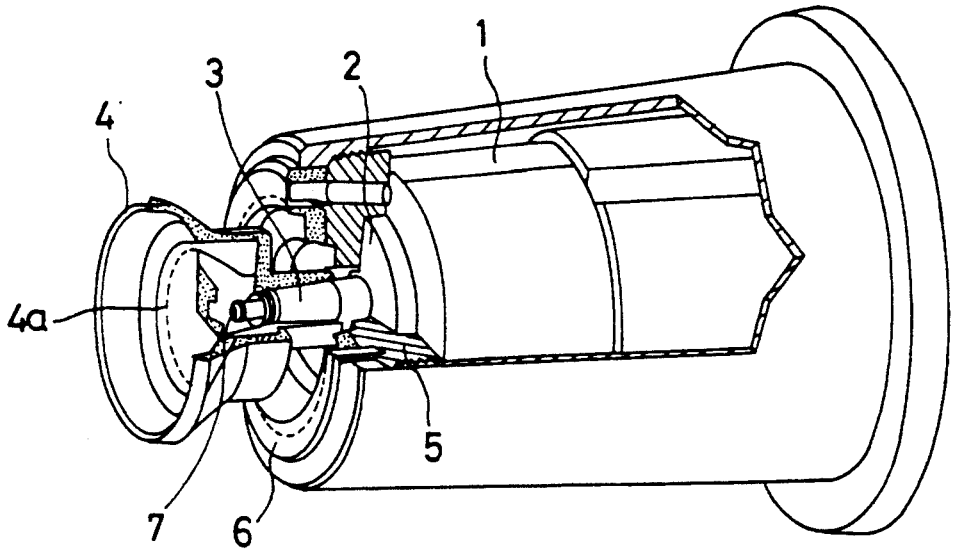
FIG. 4 is a partially cutaway perspective view of a conventional rotary atomizing electrostatic painting machine.
Figure 5:
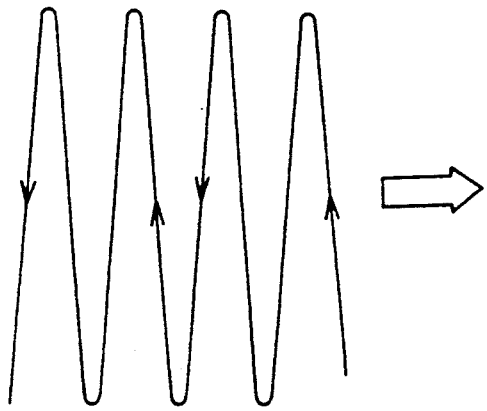
FIG. 5 is a diagram showing the orbit of the conventional reciprocating motion made by a painting machine.

Referring to FIG. 1, the body of an automobile is indicated by numeral 11. The side surfaces of this automotive body 11 are painted with a metallic paint by a method according to the invention. The body 11 is carried on a carriage 12 which is conveyed on a given conveyor line by a conveyor 13. A rotary atomizing electrostatic painting machine 14 is similar in structure to the painting machine already described in connection with FIG. 4. This machine 14 has an atomizing head **14*a* that is pointed at the side surface 11*a* of the automotive body 11 on the conveyor line. The machine 14 is connected to a support arm 16 by a shaft 17. The arm 16 has a rear portion driven by a chain 15**.

The chain 15 is trained around a pair of sprockets 18 which are spaced apart from each other vertically. One of the sprockets is driven by an electric motor 19 to rotate the chain 15 right or left. The support arm 16 is connected to one side of the chain 15 such that the arm is placed horizontally. Operation of the motor 19 rotates the chain 15 right or left to move the connected portion upward or downward. The painting machine 14 follows this movement and makes reciprocating movement. The machine 14 is connected with a moving member 21 via a link 22. This moving member 21 moves along a guide rail 20 which is curved in conformity with the curvature of the side-surface **11*a* of the automotive body 11. The posture of the machine is so controlled that the atomizing head 14*a* faces toward the side surface 11*a* of the automotive body 11** throughout the reciprocating movement described above.

Figure 2:
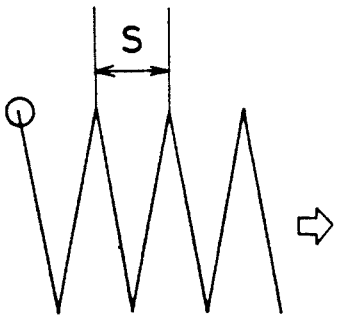
FIGS. 2 and 3 are diagrams showing the orbits of reciprocating movement made by rotary atomizing electrostatic painting machines.

In the painting system described above, the automotive body 11 is conveyed at a certain speed by the conveyor 13. The motor 19 is operated to drive the chain 15, thus moving the painting machine 14 back and forth. The center of the atomizing head **14*a* of the reciprocating machine 14 draws a sinusoidal pattern on the sprayed surface of the body 11, as shown in FIG. 2. In the present example, the pitch S between the adjacent orbits of the strokes of the reciprocating movement is controlled to a predetermined value. For this purpose, a sensor 25 for detecting the speed of the conveyance of the automotive body 11, or the speed of the conveyor 13, and a control unit 26 are installed separately from the painting machine. The output signal from the sensor 15 is supplied to the control unit 26 which delivers a signal for controlling the rotational speed of the motor 19**.

The control unit 26 comprises a calculator 27, a D/A converter 28 that converts the output digital signal from the calculator 27 into analog form, and an inverter 29. The calculator 27 receives the output signal from the sensor 25 and performs arithmetic operations described later. The inverter 29 produces a signal for providing control of the rotational speed of the motor 19 according to the output signal from the D/A converter 28. An ideal pitch S between the strokes of the reciprocation has been previously stored in the calculator 27. The calculator 27 calculates the speed R of the reciprocation (the number of strokes per minute) of the painting machine 14 according to the formula $R=C/S$ from the pitch S (cm) between the strokes of the reciprocation and from the speed C (cm/min.) of the conveyor detected by the sensor 25, and delivers a signal corresponding to the calculated speed R of the reciprocation to the D/A converter 28. The sensor 25 can be replaced by a pulse generator which produces pulses in response to the movement of the conveyor. In this case, the function of calculating the conveyor speed from the number of pulses is imparted to the calculator 27.

In the present example, the pressure of the shaping air ejected from the painting machine 14 is set high enough to match the spraying of the metallic paint. The pitch S of the reciprocation which is ideal for painting under this condition is previously found empirically. This value is stored in the calculator 27 of the control unit 26.

During the painting operation, the speed C of the conveyor 13 is monitored by the sensor 25. The output signal from the sensor 25 is supplied to the calculator 27 of the control unit 26. The calculator 27 computes the speed R of the reciprocation of the painting machine 14 according to the aforementioned formula $R=C/S$, and produces a signal corresponding to this reciprocation speed R to the D/A converter 28. This digital signal is converted into analog form by the converter 28 and sent to the inverter 29. The output signal from the inverter 29 controls the rotational speed of the motor 19. As a result, the painting machine 14 reciprocates at the speed R with the predetermined pitch S relative to the automotive body 11 conveyed by the conveyor 13. Under this condition, a metallic paint is supplied into the painting machine 14. It follows that the adjacent orbits of the strokes of the reciprocation of the machine on the side surface 11*a* of the automotive body 11 overlap with each other adequately. The produced paint film is prevented from becoming nonuniform.

Figure 3:
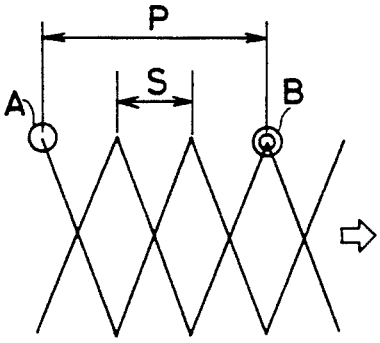

In the above example, only one painting machine 14 is used to apply a paint. The present invention is also applicable to the case in which a plurality of painting machines are regularly spaced from each other in the direction of the conveyance of the automotive body 11 to perform a painting operation using the plural machines simultaneously. We now give an example in which two painting machines A and B are employed to apply a paint. The interval P between the two machines is set to a value three times as large as the reciprocation pitch S, i.e., $P=3S$. The orbits of the strokes of the reciprocation of the two machines A and B overlap with each other with the pitch S of the reciprocation as shown in FIG. 3. At this time, the speed R′ of the reciprocation of the painting machines A and B can be found from the equation $R'=3C/2P$. An ideal reciprocation pitch S and the interval P between the two machines A and B are previously stored in the calculator 27, and the speed R′ is calculated according to the formula $R'=3C/2P$. Simultaneously with the start of the painting operation, the two painting machines A and B reciprocate at the speed R′ with the predetermined reciprocation pitch S. This prevents the produced paint film from becoming nonuniform in the same way as in the above example.

What is claimed is:

1. A method of applying a metallic paint to a curved surface of a vehicle body being conveyed at a varying speed C by a conveyor, comprising the steps of:

reciprocating a nozzle opening of each of a plurality of rotary atomizing electrostatic painting machines along a first path at right angles to the direction in which the surface to be pained is conveyed by the conveyor while simultaneously moving the corresponding nozzle along a second path normal to the first path to maintain the nozzle openings at a uniform distance form the curved surface;

detecting variations in speed C of the vehicle body being conveyed;

supplying a variable output signal to a calculator having a constant S stored therein, the constant S being a pitch between adjacent orbits of strokes of the reciprocating nozzle of each of the plurality of painting machines;

calculating a variable speed R, the number of strokes per minute, of the reciprocation according to a formula $R=C/S$;

supplying a signal indicating the value R calculated according to the formula to a converter for converting an input digital signal into analog form; and supplying an output signal from the converter to an electric motor via an inverter to rotate the motor, for controlling the speed of reciprocation in accordance with the speed C to maintain the pitch S.

2. A method of applying a metallic paint as set forth in claim 1 wherein said corresponding nozzle is positioned in the direction of the conveyance of the vehicle body.

3. A method of applying a metallic paint to a curved surface of a vehicle body being conveyed along a conveyor path, comprising the steps of:

directing a nozzle opening of a rotary atomizing electrostatic painting machine to propel paint particles along a spray path normal to the conveyor path;

driving the nozzle opening at a speed along a reciprocating path perpendicular to the conveyor path and the spray path;

shifting the nozzle opening to maintain a distance from the surface of the vehicle body while reciprocate the nozzle along the reciprocating path;

detecting the speed of the conveyor; and varying the speed of the reciprocation of the nozzle opening along the reciprocation path in accordance with variations in the detected speed of the conveyor to maintain a uniform pitch between adjacent orbits of the reciprocating path.

4. The method of claim 3 wherein the step of shifting the nozzle opening comprises guiding the nozzle along a path corresponding to the contour of the vehicle body.

5. A method of applying a metallic paint to a curved surface of a vehicle body being conveyed along a conveyor path at a speed comprising the steps of:

directing a nozzle opening of a rotary atomizing electrostatic painting machine to propel paint particles along a spray path normal to the conveyor path;

driving the nozzle opening along a reciprocating path perpendicular to the conveyor path and the spray path;

shifting the nozzle opening to maintain a uniform distance from the surface of the vehicle body while reciprocating the nozzle along the reciprocating path;

storing a value corresponding to a selected pitch of adjacent orbits of the reciprocating path;

detecting the speed of the conveyance of the object;

calculating a variable speed of the nozzle along the reciprocable path in accordance with the selected pitch value and the detected speed corresponding to the speed of the conveyance; and driving the nozzle along the reciprocable path in accordance with the detected speed to maintain the selected pitch of adjacent orbits.

* * * * *

UNITED STATES PATENT AND TRADEMARK OFFICE

CERTIFICATE OF CORRECTION

PATENT NO. : 5,324,547

DATED : June 28, 1994

INVENTOR(S) : Yutaka OHHASHI et al.

It is certified that error appears in the above-identified patent and that said Letters Patent is hereby corrected as shown below:

Claim 1, column 5, line 53, change "pained" to --painted--.

Signed and Sealed this

Twenty-second Day of November, 1994

*Attest:*

*Attesting Officer*

Bruce Lehman

BRUCE LEHMAN

*Commissioner of Patents and Trademarks*